United States Patent [19]

Itoh

[11] 4,383,310

[45] May 10, 1983

[54] PICKUP CARTRIDGE OF MOVABLE MAGNET TYPE

[75] Inventor: Masashi Itoh, Settsu, Japan

[73] Assignee: Matsushita Electric Industrial Co., Ltd., Osaka, Japan

[21] Appl. No.: 202,697

[22] Filed: Oct. 30, 1980

[30] Foreign Application Priority Data

Nov. 1, 1979 [JP] Japan ..... 54-142665

[51] Int. Cl.[3] ..... H04R 11/08; H04R 11/12

[52] U.S. Cl. ..... 369/136; 369/146

[58] Field of Search ..... 369/136, 146, 148, 149, 369/170

[56] References Cited

U.S. PATENT DOCUMENTS 4,237,347 12/1980 Burundukov ..... 369/136

*Primary Examiner*—Alan Faber

*Attorney, Agent, or Firm*—Birch, Stewart, Kolasch and Birch

[57] ABSTRACT

A stereo pickup cartridge of a movable magnet type comprising three movable magnets. The magnetic axis of each of the magnets is orthogonal to the cantilever shaft.

8 Claims, 18 Drawing Figures

PICKUP CARTRIDGE OF MOVABLE MAGNET TYPE

BACKGROUND OF THE INVENTION

The present invention relates to a pickup cartridge of a movable magnet type, which can draw right and left channel signals separated independently from the modulation grooves of a record.

Generally, as a pickup cartridge of a movable magnet type, it is known that four pole pieces are arranged in a square shape to make a common gap, and a rod-shaped magnet provided at the other end of a cantilever with a needle point at its tip end is caused to be oscillated within the common gap to draw the right and left channel signals separated from the modulation grooves of the record. However, in the pickup cartridge of movable magnet type using such rod-shaped magnet of conventional, a magnet having a magnetic axis parallel to the axial direction of a cantilever is required to be used as a rod-shaped magnet and the central portion thereof is required to be supported for free angular motion. In addition, to cause the sufficient power generation, the rod-shaped magnet itself is required to be considerably made longer in the axial direction of the cantilever. Thus, the effective mass of the vibration system including the rod-shaped magnet becomes considerably larger, thus resulting in decreasing of the sensitivity thereof.

In order to solve a problem of the sensitivity decrease of the movable magnet type pickup cartridge using such rod-shaped magnet, it is proposed that a magnet holder is provided at the other end of the cantilever and two rod-shaped magnets are disposed on the magnet holder so that they may become orthogonal to the maximum sensitivity axis of the modulation groove of a 45°-45° system stereo record. However, in the pickup cartridge of a movable magnet type wherein two rod-shaped magnets are disposed, being orthogonal to the maximum sensitivity axis of the modulation groove of the 45°-45° system stereo record, two rod-shaped magnets are used, which have magnetic axis parallel to the maximum sensitivity axis of the modulation groove, so that the opposed portion of the movable magnet is necessarily caused in the different polarity or the same polarity. Thus, with the above construction of pickup cartridge, the magnetic flux distribution is deformed and is unbalanced around the maximum sensitivity axis and, accordingly, the modulation axis changes, resulting in various problems such as varied output, deteriorated separation or the like.

SUMMARY OF THE INVENTION

The object of the present invention is to provide a pickup cartridge of a movable magnet type, which is free from the disadvantages of such conventional type as described hereinabove.

Another object of the present invention is to provide a pickup cartridge of a movable magnet type, which can draw right and left channel signals separated from the modulation grooves of a record, and which can reduce the effective mass without decrease in sensitivity and is superior in characteristics.

According to the present invention, there provides a pickup cartridge of a movable magnet type wherein a movable magnet having a magnetic axis parallel to a vertical axis orthogonal to the shaft of a cantilever and two movable magnets each having a magnetic axis parallel to a horizontal axis orthogonal to the shaft of said cantilever are provided at the rear end of said cantilever with a needle point at its tip end, the movable magnet on said vertical axis side and the movable magnets on said horizontal axis side are magnetized to be different in magnetizing direction opposed to the shaft of said cantilever, a group of said movable magnets are supported for free angular motion at the other end of said cantilever to construct a vibration system, adjacent movable magnets from the group of movable magnets constituting said vibration system are made a pair and pole pieces magnetically connected to yokes each having generating coils therearound are oppositely disposed with respect to the movable magnets as the pair thereby to construct a generating portion.

The object and other objects, features, aspects and advantages of the present invention will become more apparent from the following detailed description of the present invention when taken in conjunction with the accompanying drawings.

DETAILED DESCRIPTION OF THE INVENTION

Figure 1:
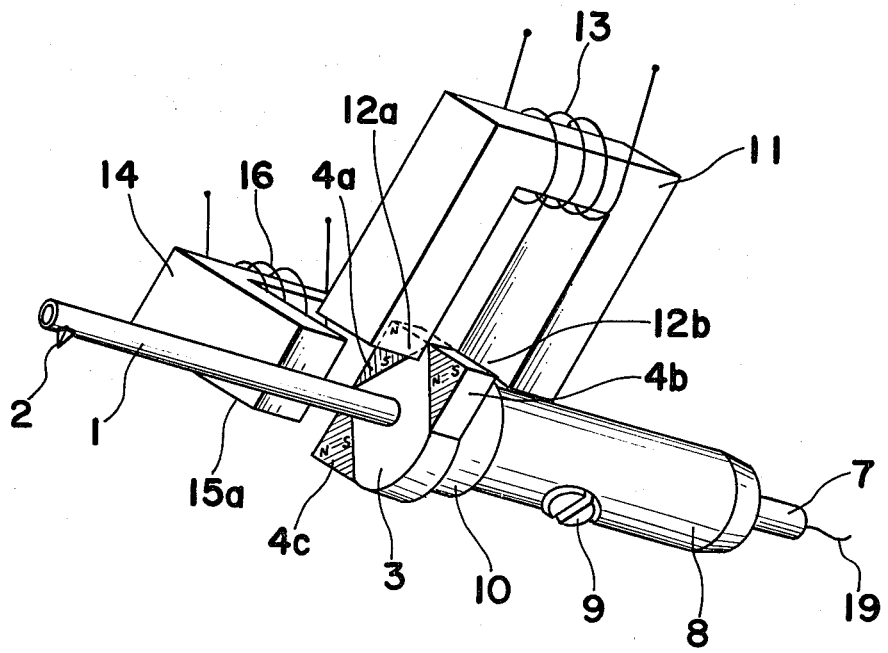
FIG. 1 is a perspective view showing an essential-portion of a pickup cartridge of a movable magnet type in accordance with one embodiment of the present invention.

Before the description of the present invention proceeds, it is to be noted that like parts are designated by like reference numerals throughout the accompanying drawings.

Figure 2:
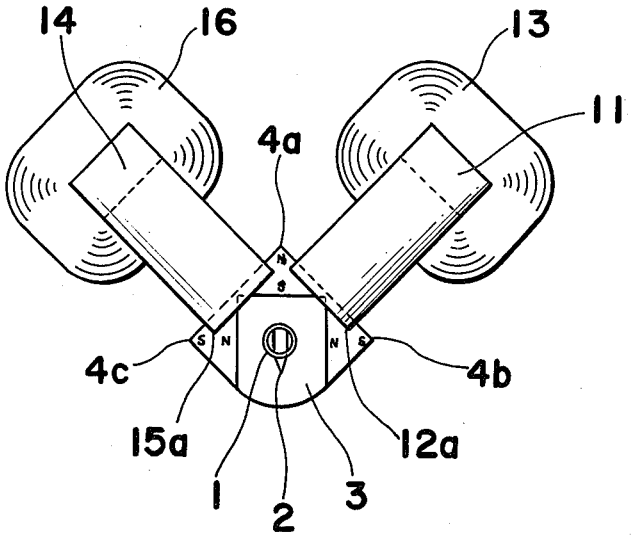
FIG. 2 is a front view of the cartridge of FIG. 1.
Figure 3:
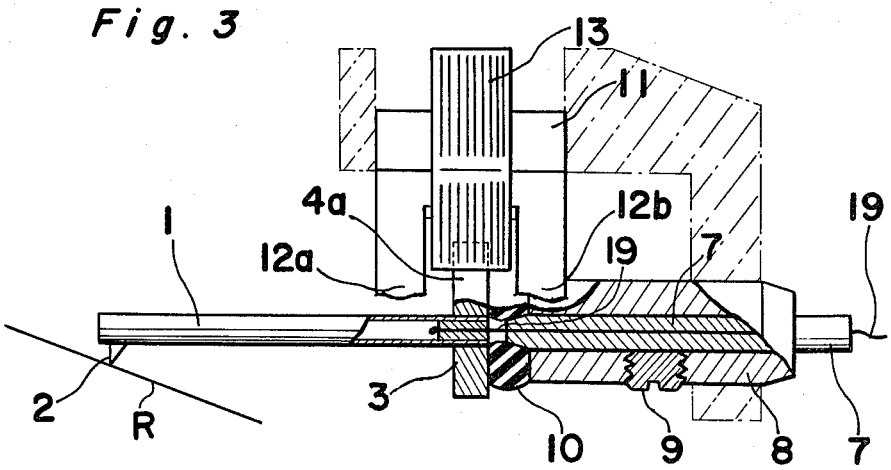
FIG. 3 is a side elevational view as partly cross-sectioned, of the cartridge of FIG. 1.
Figure 4:
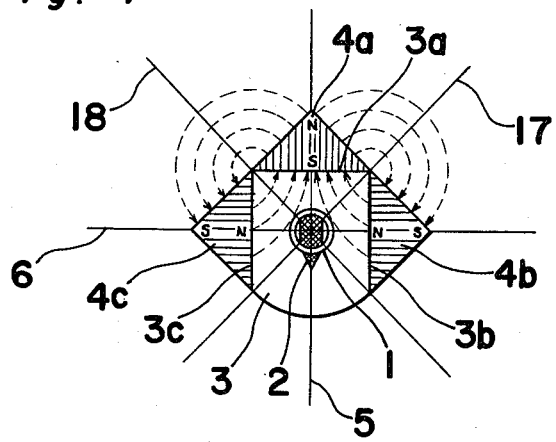
FIG. 4 is a schematic view for illustrating the vibration of the cartridge of FIG. 1.

Referring first to FIG. 1 through FIG. 3, there is shown one embodiment of a pickup cartridge of a movable magnet type according to the present invention, wherein a cantilever 1 is formed of a tube made of, for example, aluminum pipe, boron pipe, titanium pipe or the like and is provided, at its tip end, with a needle point 2 of diamond, sapphire or the like, and a magnet holder 3 is mounted on the other end of the cantilever 1 and is formed into a desired, given shape with a soft-magnetic material or a non-magnetic material such as plastic. The magnet holder 3 has at its outside periphery three different planes consisting of two mutually parallel planes 3*b*, 3*c* and one plane 3*a*, which is orthogonal to the two planes 3*b*, 3*c*, and each of movable magnets 4*a*, 4*b*, 4*c* is mounted on the respective plane 3*a*, 3*b*, 3*c* of the magnet holder 3. The movable magnets 4*a*, 4*b*, 4*c* are made of a rare earth cobalt magnet material having high energy product, are constructed, respectively, into the plate shape of a right-angle isosceles triangle and are magnetized in the direction orthogonal to the respective bottom sides which are fixedly attached to the planes 3*a*, 3*b*, 3*c* of the magnet holder 3. Namely, these movable magnets 4*a*, 4*b*, 4*c* are made from a square plate into the right-angle isosceles triangles through the cutting operation. As shown in FIG. 4, one movable magnet 4*a* attached on the orthogonal plane 3*a* has a magnetic axis of N-S parallel to the vertical axis 5 of the magnet holder 3, while the other two movable magnets 4*b*, 4*c* each attached on the parallel planes 3*b*, 3*c* have magnetic axes of N-S parallel to the horizontal axis 6 of the magnet holder 3, but opposite with respect to each other in the magnetizing direction. In each arrangement, the one movable magnet 4*a* is vertically magnetized with N-pole at its top end and with S-pole at its bottom plane attached to the plane 3*a* of the magnetic holder 3, while, the left and right side movable magnets 4*b*, 4*c* are horizontally magnetized with S-pole at its top end and with N-pole at its side plane attached to the planes 3*b*, 3*c* of the magnetic holder 3, respectively. A support pipe 7 is fixedly mounted onto a flexible suspension wire 19, which is made of a nylon and the like and is drawn rearwardly out of the other end of the cantilever 1 onto which the magnet holder 3 is mounted. With modification, the wire 19 may be drawn out from the center portion in the rear side plane of the magnet holder 3. A cylindrical support body 8 made of a non-magnetic material is used to insert the support pipe therein, and a mounting screw 9 is used to secure the support pipe 7 to the support body 8. A damper 10 composed of a viscoelasticity material such as butyl rubber and the like is provided between the magnet holder 3 and the support body 8 to give damping effects against the vibrations of the magnet holder 3 and the movable magnets 4*a*, 4*b*, 4*c*.

It is to be noted that there provides between the magnet holder 3 and the support body 8 a gap to be bridged by the wire 19 of length enough to cause to render the damping effects of the damper 10 of which length is vary depending upon the depression thereof. Accordingly, the movable magnets 4*a*, 4*b*, 4*c* retained by the magnet holder 3 on the other end of said cantilever 1 are supported onto the support body 8 through the damper 10 by fixing the mounting screw 9, which is screwed on the support body 8, onto the support pipe 7, which is connected to the cantilever 1 by the wire 19. The damper 10, into which the suspension wire 19 is extended before the mounting screw 9 is screwed onto the support pipe 7, is disposed between the rear face of the magnet holder 3, the movable magnets 4*a*, 4*b*, 4*c* and the end portion of the support body 8, and is properly depressed to support the movable magnets 4*a*, 4*b*, 4*c* on the support body 8 for free angular motion thereof. The support body 8 is mounted on the cartridge body (not shown) in a known manner. One yoke 11 for right-hand channel is formed of U-shape and is made of a ferrite material superior in high frequency characteristics. The yoke 11 for right-hand channel having pole pieces 12*a*, 12*b* at its tip ends is mounted on the cartridge body in a known manner at a position to be opposed to the movable magnets 4*a*, 4*b* so that the movable magnets 4*a*, 4*b* are inserted between the pole pieces 12*a* and 12*b* of the tip ends of the yoke, and a generating coil 13 for right-hand channel is wound around the center portion of the yoke 11. The other yoke 14 for left-hand channel having pole pieces 15*a*, 15*b* at its tip ends is also formed of U-shape and is made of a ferrite material superior in such as high frequency characteristics. The yoke 14 is mounted on the cartridge body in a known manner at a position to be opposed to the movable magnets 14*a*, 14*c* so that the movable magnets 4*a*, 4*c* are inserted between the pole pieces 15*a*, 15*b* of the tip ends of the yoke, and generating coils 16 for left-hand channel are wound around the center portion of the yoke 14.

In a movable magnet type pickup cartridge of such construction as described hereinabove, a pair of the movable magnets 4*a* and 4*c*, 4*a* and 4*b* are disposed in linear symmetry with respect to +45° and −45° inclining boundary lines 17, 18 corresponding to the maximum sensitivity axes of the modulation grooves of a 45°–45° system stereo record R, as shown in FIG. 4. Also, the magnetic axes of the movable magnets 4*b* and 4*c*, and 4*a* are parallel in direction to the horizontal axis 6 and the vertical axis 5 orthogonal to the shaft of the cantilever 1, respectively. In addition, the movable magnet 4*a* corresponding to the vertical axis 5 and the movable magnets 4*b*, 4*c* correspnonding to the horizontal axis 6 are opposite in magnetizing directions with respect to each other. Thus, the respective magnetic fluxes generating between the movable magnets 4*a* and 4*b*, 4*a* and 4*c* which make a pair among the movable magnets 4*a*, 4*b*, 4*c* are balanced in linear symmetry with respect to the +45° and −45° inclining boundary lines 17, 18, whereby problems such as unbalance in output voltage between right and left channels, crosstalk between the right and left channels, or the like are completely removed. Also, as the high energy substance is used as the movable magnets 4*a*, 4*b*, 4*c*, the movable magnets 4*a*, 4*b*, 4*c* are small in shape and the effective mass of the vibration system including the movable magnets becomes more smaller, thus preventing the sensitivity from being reduced.

Now, assuming that the needle point 2 of the cantilever 1 traces the modulation grooves of the 45°–45° system stereo record to wave the movable magnets 4*a*, 4*b*, 4*c* in the direction of the maximum sensitivity axis for the right-hand channel corresponding to −45° inclining boundary line 18, at this time, a pair of movable magnets 4*a*, 4*b* vibrate with respect to the yoke 11 and a pair of movable magnets 4*a*, 4*c* move in parallel to the yoke 14 so that the output signals can be picked up to the generating coils 13 wound around the yoke 11. On the other hand, assuming that the needle point 2 of the cantilever 1 traces the modulation groove of the 45°–45° system stereo record to wave the movable magnets 4*a*, 4*b*, 4*c* in the direction of the maximum sensitivity axis for the left-hand channel corresponding to +45° inclining boundary line 17, at this time, a pair of movable magnets 4*a*, 4*b* move in parallel to the yoke 11 and a pair of movable magnets 4*a*, 4*c* vibrate with respect to the yoke 14 so that the output signals can be picked up to the generating coil 16 wound around the yoke 14. Accordingly, when a pair of the movable magnets 4*a* and 4*b*, 4*a* and 4*c* which make a pair among the movable magnets 4*a*, 4*b*, 4*c* respectively vibrate within the yokes 11, 14, the magnetic fluxes flowing through the yokes 11, 14 are reversed with each other to become alternating magnetic fluxes, which cause AC starting forces in the generating coils 13, 16.

Figure 5:
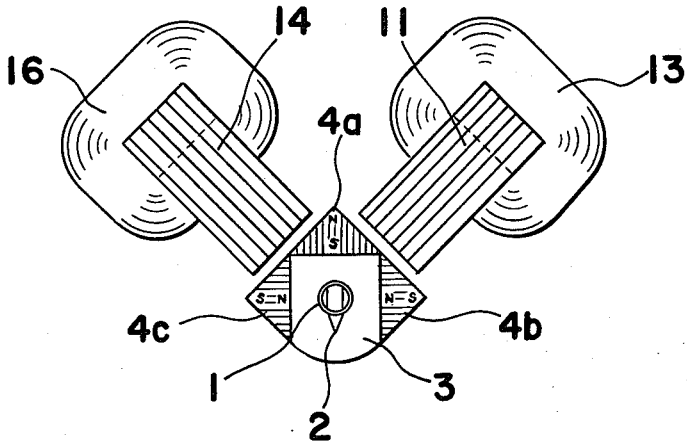
FIG. 5 is a front view showing the modified example of the cartridge of FIG. 2.

Although in the above-described embodiment, the ferrite material is used as the yokes 11, 14, a laminated yoke wherein a lot of grooved plates made of a high magnetic-permeability material such as permalloy or the like are piled up to decrease eddy-current loss may be used as the yokes 11, 14, as shown in FIG. 5, or single-plate yoke made of a high magnetic-permeability material may be used (not shown). If and when a pair of yokes 11, 14 are provided opposedly disposed against the movable magnets 4*a* to 4*c* with providing a gap therebetween so that the movable magnets 4*a* and 4*b*, 4*a* and 4*c*, which make a pair respectively, do not enter between the pole pieces 12*a* and 12*b*, 15*a* and 15*b* at the tip ends of the yokes 11, 14, as shown in FIG. 5, a vibration system wherein the cantilever 1 has at its tip end the needle point 2, at its other end the movable magnets 4*a*, 4*b*, 4*c* retained by the magnet holder 3 for free angular motion conveniently allows the needle 2 to be replaced in the axial direction of the cantilever 1 with respect to a generating portion composed of the yokes 11, 14, etc.

Figure 6:
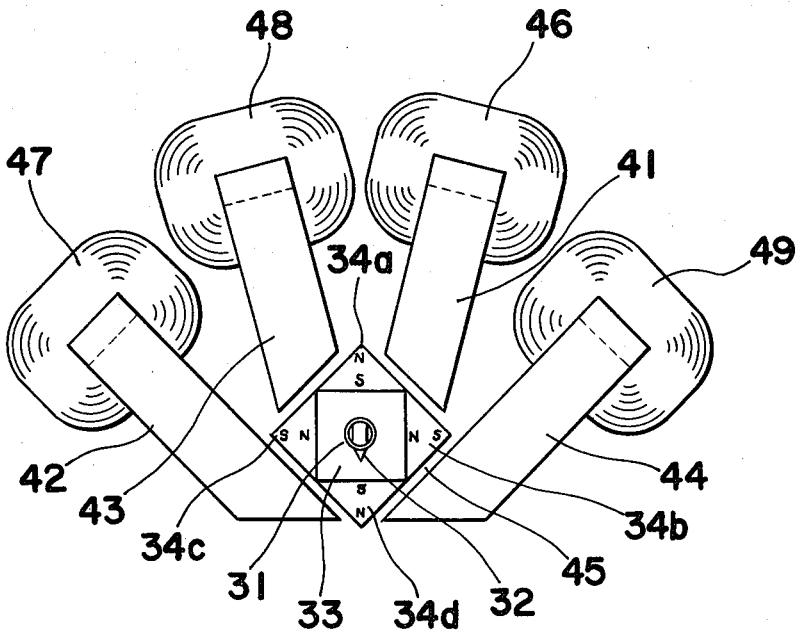
FIG. 6 is a front view showing another example of the cartridge of FIG. 2.
Figure 7:
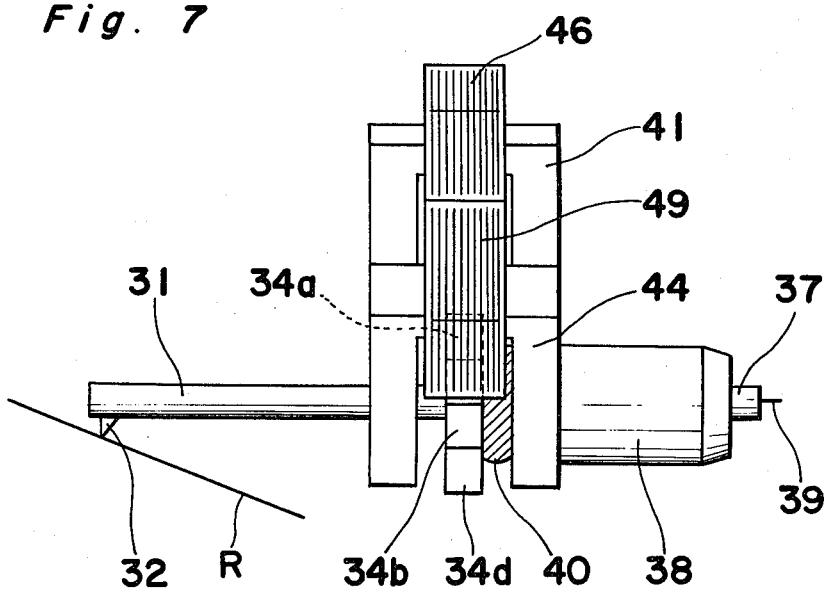
FIG. 7 is a side elevational view of the cartridge of FIG. 6.
Figure 8:
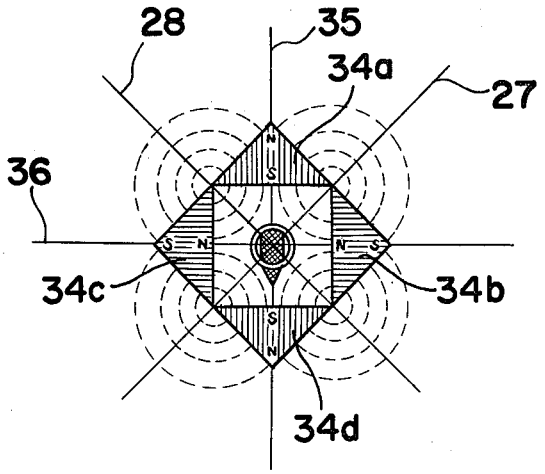
FIG. 8 is a schematic view for illustrating the vibration of the cartridge of FIG. 6.

FIG. 6 and FIG. 7 show another embodiment of a movable magnet type pickup cartridge of the present invention, wherein a square-shaped magnet holder 33 having four different planes at the outside periphery is mounted at the other end of the cantilever 31, which is provided at its tip end with a needle point 32, and plate-shaped movable magnets 34*a*, 34*b*, 34*c*, 34*d* each being of right-angle isosceles triangle are provided, respectively, on the four planes of the magnet holder 33. As shown in FIG. 8, in the movable magnets 34*a*, 34*b*, 34*c*, 34*d*, two movable magnets 34*a*, 34*d* having a magnetic axis parallel to a vertical axis 35 and other two movable magnets 34*b*, 34*c* having a magnetic axis parallel to a horizontal axis 36 are used, which are opposite in magnetizing direction with respect to each other. In such arrangement, each of the top and bottom movable magnets 34*a*, 34*d* is vertically magnetized with N-pole at its top end and with S-pole at its bottom plane attached to the plane of the magnetic holder 33, while, each of the left and right side movable magnets 34*b*, 34*c* horizontally magnetized with S-pole at its top end and with N-pole at its side plane attached to the plane of the magnetic holder 33. Two sets of movable-magnet pairs 34*a*, 34*b*, 34*c*, 34*d* and 34*a*, 34*c*, 34*b*, 34*d* are disposed in linear symmetry with respect to +45° and −45° inclining boundary lines 27, 28 which are corresponding to the maximum sensitivity axes of the modulation grooves of a 45°–45° system stereo record. A support pipe 37 of a suspension wire 39 which has been rearwardly drawn through a damper 40 from the cantilever 31 to the support pipe 37 is inserted into a cylindrical support body 38, and the support pipe 37 is mounted on the support body 38 through the screwing operation of a mounting screw (not shown) into the support body 38 so as to properly compress the damper 40 existing between the rear faces of the magnet holder 33, the movable magnets 34*a*, 34*b*, 34*c*, 34*d* and the end face of the support body 38. Accordingly, the movable magnets 34*a*, 34*b*, 34*c*, 34*d* retained, by the magnet holder 33, on the other end of the cantilever 31 are supported on the support body 38 through the proper damping force of the damper 40 for free angular motion thereof.

A pair of U-shaped yokes 41, 42 for right-hand channel and a pair of U-shaped yokes 43, 44 for left-hand channel are assembled so that the pole pieces of the tip ends of these yokes may become opposite with respect to each other, whereby a square space 45 is constructed for arrangement of a vibration system including the movable magnets 34*a*, 34*b*, 34*c*, 34*d* supported on the magnet holder 33. In the vibration system which is disposed within the square space 45, the movable magnets 34*a* and 34*b*, 34*c* and 34*d* which make pairs are oppositely disposed into the right-hand channel of the yokes 41, 42 so that they may not enter between the pole pieces of the yokes 41 and 42, while the movable magnets 34*a* and 34*c*, 34*b* and 34*d* which make pairs are oppositely disposed into the left-hand channel so that they may not enter between the pole pieces of the yokes 43 and 44. Generating coils 46, 47, 48, 49 are wound, respectively, on the yokes 41, 42, 43, 44, and the output voltage can be drawn to the coils 40, 47, 48, 49 according to the same generating principle as that of a first embodiment. The generating coils 46, 47 and 48, 49 can be connected in parallel to draw the output signal of the double voltage to the right and left channels of the yokes 41 to 44.

In the above-described two embodiments, in addition to the right-angled isosceles triangle, equilateral triangle magnetized in a direction orthogonal to the bottom side, mere isosceles triangle or square magnetized in a direction parallel to one of the diagonal lines can be used as the movable magnet to be attached on the magnet holder.

Figure 9:
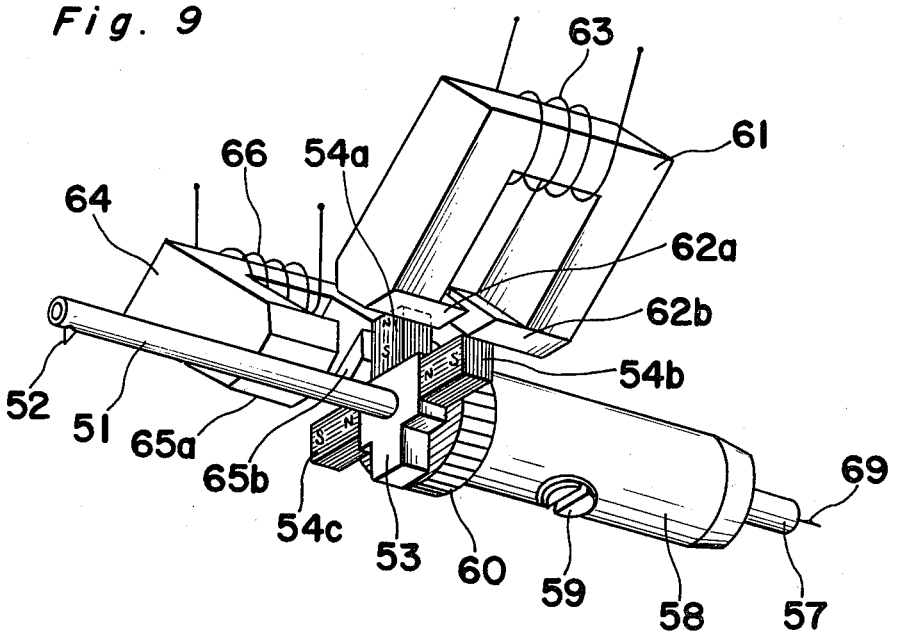
FIG. 9 is a perspective view showing an essential-portion of a pickup cartridge of a movable magnet type in accordance with a further embodiment of the present invention.
Figure 10:
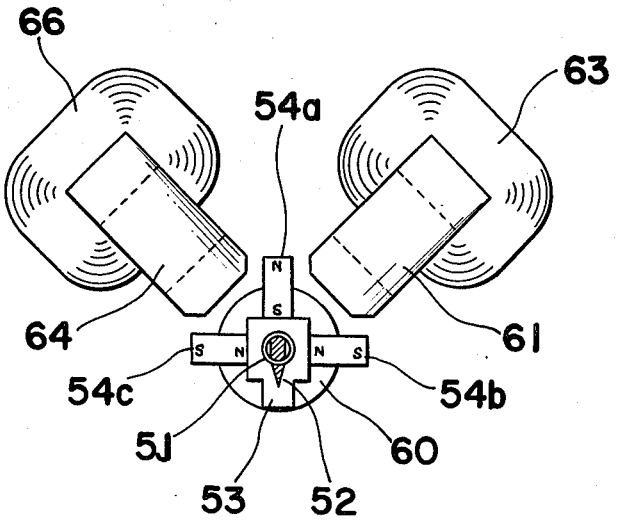
FIG. 10 is a front view of the cartridge of FIG. 9.
Figure 11:
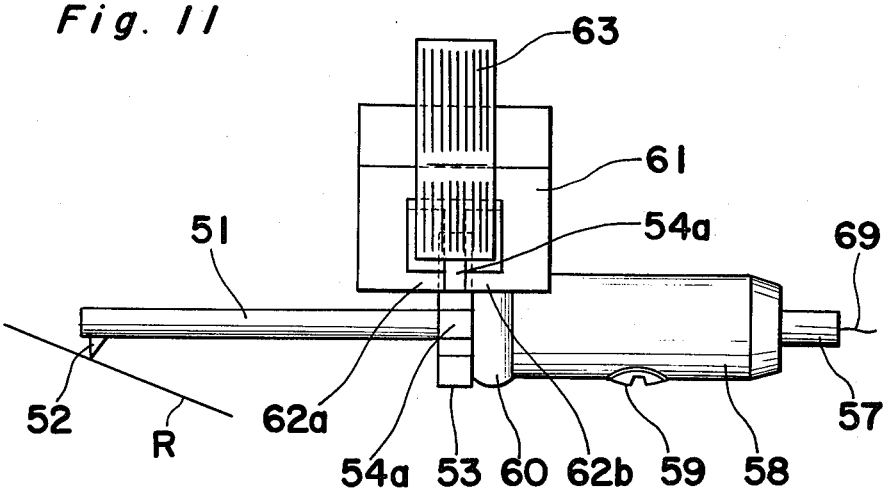
FIG. 11 is a side elevational view of the cartridge of FIG. 9.
Figure 12:
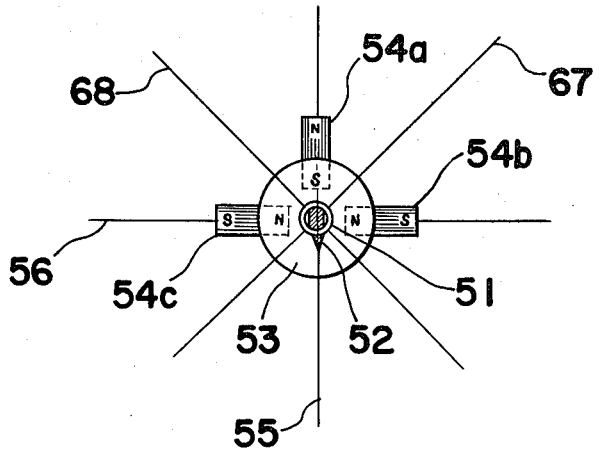
FIG. 12 is a schematic view for illustrating the vibration of the cartridge of FIG. 9.

Referring to FIG. 9 through FIG. 11, there shows a further embodiment of a movable magnet type pickup cartridge of the present invention, wherein a magnet holder 53 having the shape of approximately rectangle is provided at the other end of a cantilever 51, which has a needle point 52 at its tip end, and rod shaped movable magnets 54*a*, 54*b*, 54*c* are disposed respectively on the three planes of the magnet holder 53. These movable magnets 54*a*, 54*b*, 54*c* are used, wherein the one movable magnet 54*a* disposed at the center of the magnet holder 53 with a magnetic axis parallel to a vertical axis 55 and the other two movable magnets 54*b*, 54*c* disposed at the both sides of the magnet holder 53 with a magnetic axis parallel to a horizontal axis 56 are opposite in the magnetic direction, as shown in FIG. 12. Movable magnets 54*a* and 54*b*, 54*a* and 54*c* are disposed to become pairs respectively in linear symmetry with respect to +45° and −45° inclining boundary lines 67, 68 which are corresponding to the maximum sensitivity axes of the modulation grooves of the 45°–45° system stereo record. When a support pipe 57 of a suspension wire 69 which has been rearwardly drawn from the cantilever 31 is inserted into a cylindrical support body 58, and the support pipe 57 is mounted on the support body 58 through the screwing operation of a mounting screw 59 into the support body 58, the cantilever 31 is fixed on the support body 58 through a damper 60 into which the suspension wire is inserted to properly compress the damper existing between the rear faces of the magnet holder 53, the movable magnets 54*a*, 54*b*, 54*c* and the end face of the support body 58 by means of fixing the support body 58 on the support pipe 57. The movable magnets 54*a*, 54*b*, 54*c* retained, by the magnet holder 53, on the other end of the cantilever 51 are supported on the support body 58 through the proper damping force of the damper for free angular motion thereof. A yoke 61 for right-hand channel is opposed to the space between the movable magnet pair 54*a* and 54*b* so that the movable magnets 54*a*, 54*b* may not enter between the pole pieces 62*a*, 62*b* of the tip ends of the yoke 61, and a generating coil 63 for right-hand channel is wound around the yoke 61. A yoke 64 for left-hand channel is opposed to the space between the movable magnet pair 54*a*, 54*b* so that the movable magnets 54*a*, 54*b* may not enter between the pole pieces 65*a*, 65*b* of the tip ends of the yoke 64, and a generating coils for left-hand channel are wound around the yoke 64.

In a movable magnet type pickup cartridge of the embodiment as described hereinabove, rod-shaped movable magnets 54*a*, 54*b*, 54*c* are disposed in linear symmetry with respect to +45° and −45° inclining boundary lines 67, 68 which are corresponding to the maximum sensitivity axes of a 45°–45° system record, as shown in FIG. 12. The magnetic axes of the rod-shaped movable magnets 54*b* and 54*c*, and 54*a*, are respectively parallel in direction to the horizontal axis 56 and the vertical axis 55 orthogonal to the shaft of the cantilever 51. In addition, the movable magnet 54*a* corresponding to the vertical axis 55 and the movable magnets 54*b*, 54*c* corresponding to the horizontal axis 56 are opposite in magnetizing direction with respect to each other. Thus, the respective magnetic fluxes between the movable magnets 54*a*, 54*b* and 54*a*, 54*c*, which make a pair among the movable magnets 54*a*, 54*b*, 54*c* are substantially parallel in linear symmetry with respect to +45° and −45° inclining boundary lines 67, 68 which is corresponding to the maximum sensitivity axes of the modulation grooves of the 45°–45° system stereo record, whereby problems such as unbalance in output voltage between right and left channels, crosstalk between the right and left channels, or the like are completely removed. Also, as the magnetic material of the high energy substance is used, the movable magnets 54*a*, 54*b*, 54*c* become smaller in dimensions and the effective mass of the vibration system including the movable magnets becomes more smaller, thus preventing the sensitivity from being reduced.

Figure 13:
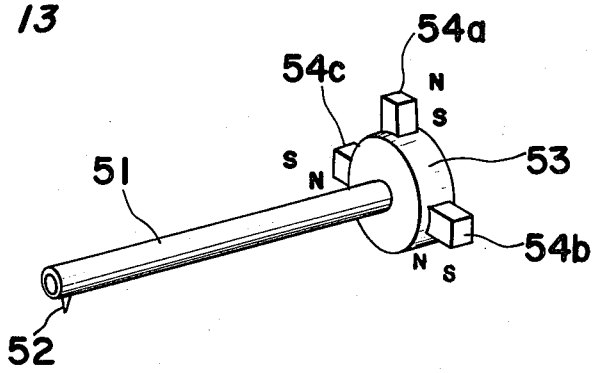
FIG. 13 and FIG. 14 are perspective views each showing the modified example of a portion of the cartridge of FIG. 9.
Figure 14:
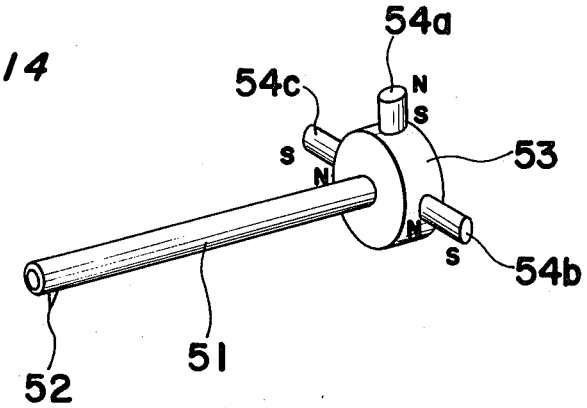

In the above-described embodiment, the pole pieces 62*a*, 62*b* and 65*a*, 65*b* are engaged between the movable magnet pairs 54*a*, 54*b* and 54*a*, 54*c* and the vibration system including the movable magnets 54*a*, 54*b*, 54*c* allows the needle to be replaced in the axial direction of the cantilever 51. However, if no consideration is necessary to be given to the requirement of the needle replacement in the axial direction of the cantilever 51, the movable magnet pairs 54*a*, 54*b* and 54*a*, 54*c* may be engaged between the pole pieces of the tip ends of the yokes 61, 64. Also, the rod-shaped movable magnets 54*a*, 54*b*, 54*c* to be mounted on the magnet holder 53 may be square pillar in shape, as shown in FIG. 13 or may be circular cylinder in shape, as shown in FIG. 14. As the yokes 61, 64, single plate yoke or laminated yoke may be used, which is made of, in addition to ferrite material, high magnetic-permeability material such as bent and worked permalloy or the like.

Figure 15:
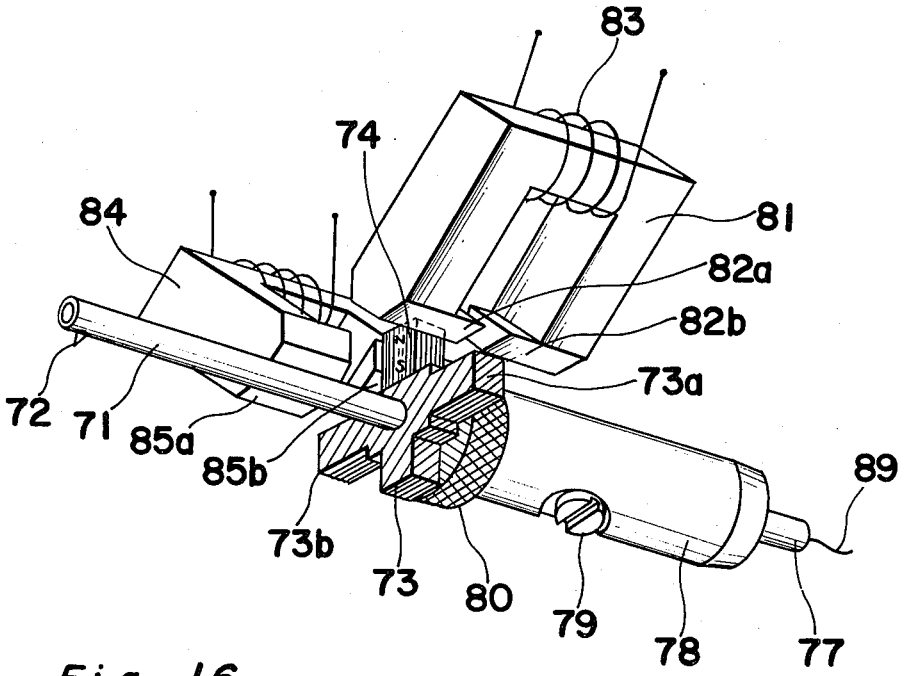
FIG. 15 is a perspective view showing an essential-portion of a pickup cartridge of a movable magnet type in accordance with still another embodiment of the present invention.
Figure 16:
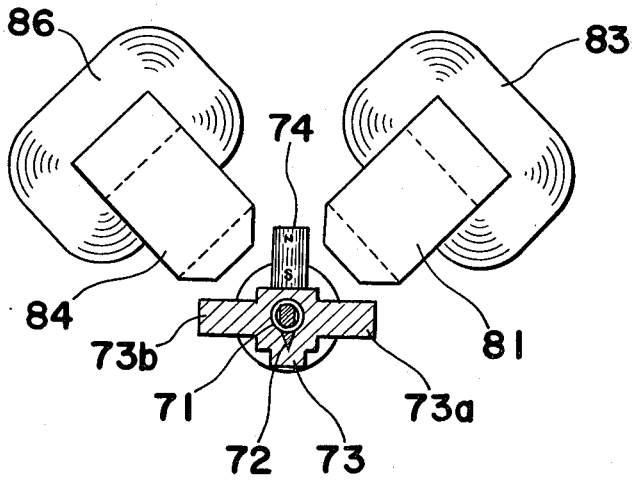
FIG. 16 is a front view of the cartridge of FIG. 15.
Figure 17:
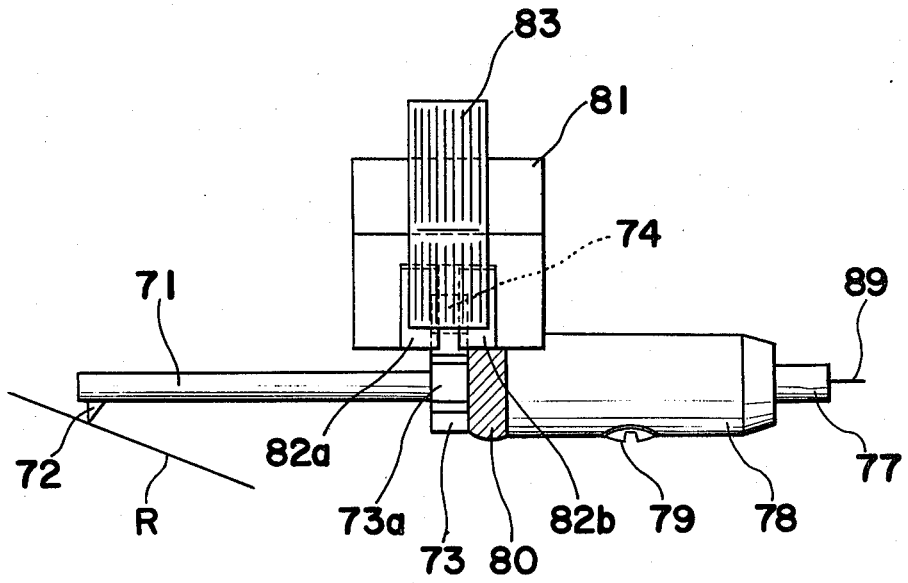
FIG. 17 is a side elevational view of the cartridge of FIG. 15.
Figure 18:
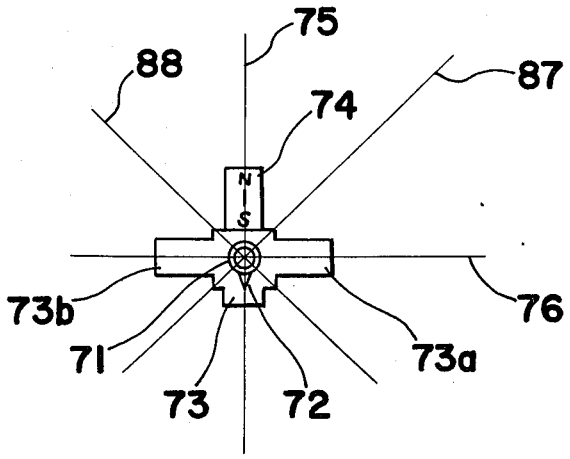
FIG. 18 is a schematic view for illustrating the vibration of the cartridge of FIG. 15.

FIG. 15 through FIG. 17 show still another embodiment of a movable magnet type pickup cartridge of the present invention, wherein a magnet holder 73 composed of a soft magnetic material is provided at the other end of a cantilever 71, which has a needle point 72 at its tip end, and is constructed in T-shape as shown in FIG. 18 with projections 73*a*, 73*b* in the direction of the horizontal axis 76. A rod-shaped movable magnet 74 mounted on the upper center portion of the magnet holder 73 is located at the center of the projections 73*a*, 73*b* and extends in the direction of a vertical axis 75 which is orthogonal to the horizontal axis 76.

Since the rod-shaped movable magnet 74 is formed of one pillar having N and S poles at both ends and is mounted, at its S-poles, on the magnet holder 73, the tip ends of the respective projections 73*a*, 73*b* made of a soft magnetic material become effectively opposite in magnetic pole to the tip end of the movable magnet 74 and constructs two closed magnetic circuits with respect to the one movable magnet 74 including the respective projections 73*a*, 73*b*. Each of the two projections 73*a*, 73*b* of the magnetic holder 73 functions as a rod-shaped movable magnet, which is effectively different in polarity from the rod-shaped magnet 74 having a magnetic axis in the direction of a vertical axis 75 orthogonal to the shaft of the cantilever 71. Accordingly, the one rod-shaped movable magnet 74 and the projection 73*a* of the magnet holder 73 effectively becomes a movable magnet, which becomes orthogonal to +45° inclining boundary line 87 which is corresponding to the maximum sensitivity axis for left-hand channel of the modulation grooves of the 45°–45° system stereo record. On the other hand, the one rod-shaped movable magnet 74 and the projection 73*b* of the magnet holder 73 effectively becomes a movable magnet, which becomes orthogonal to −45° inclining boundary line 88 which is corresponding to the maximum sensitivity axis for right-hand channel of the modulation grooves of the 45°–45° system stereo record. A support pipe 77 is mounted on a suspension wire 89, which has been drawn rearwardly of the cantilever 71, and is inserted through a cylindrical support body 78. The cantilever 71 is supported on the support body 78 which is fixedly mounted on the support pipe 77 by means of a mounting screw 79 through the wire 89 and a damper 80 provided between the magnet holder 73 and the support body 78 so as to mount on the support body 78 a movable magnet 74, which is retained, by the magnet holder 73, on the other end of the cantilever 71. When the mounting screw 79 has been screwed onto the support body 78, the damper 80 is properly compressed between the magnet holder 73 and the support body 78 so that a movable magnet which is substantially provided between the one movable magnet 73 and the two projections 73*a*, 73*b* is supported on the support body 78 through the damper 80 and the wire 89 for free angular motion thereof, the damper having the suspension wire 89 inserted thereinto and existing between the rear face of the magnet holder 73, the movable magnet 74 and the end face of the support body 78. A yoke 81 for right-hand channel is opposedly disposed within the space of quarter or less between the movable magnet 74 and the one projection 73*a* so that the movable magnet 74 and one projection 73*a* may not enter between the pole pieces 82*a* and 82*b* of the tip ends of the yoke, and generating coils for right-hand channel are wound around the yoke 81. A yoke 84 for left-hand channel is opposedly disposed within the space of quarter or less between the movable magnet 74 and the other projection 73*b* so that the movable magnet 74 and the other projection 73*b* may not enter between the pole pieces 85*a* and 85*b* of the tip ends of the yoke, and generating coils 86 for left-hand channel are wound around the yoke 84.

In a movable magnet type pickup cartridge of the embodiment as described hereinabove, two movable magnets which are effectively constructed between the rod-shaped movable magnets 74 and two projections 73*a*, 73*b* vibrate in accordance with the angular motion of the needle point 72 to generate alternating magnetic fluxes within the yokes 81, 84 so that the output signals separated into the right and left channels are drawn to the generating coils 83, 86.

In addition, even if the pole pieces 82*a*, 82*b* and 85*a*, 85*b* of the tip ends of the yokes 81, 84 are engaged between the movable magnet 74 and two projections 73*a*, 73*b* which effectively constructs movable magnets, the vibration system including the movable magnet 74 allows the needle to be replaced in the axial direction of the cantilever 71. However, unless any consideration is necessary to be given to the needle replacement to the axial direction of the cantilever 71, the movable magnet 74 and the two projections 73*a*, 73*b* may be engaged between the pole pieces of the tip ends of the yokes 81, 84. Also square pillar, circular cylinder or the like may be used as the rod-shaped magnet 74 to be mounted on the magnet holder 73.

With the above embodiments as described hereinabove in connection with drawings, the present invention provides a pickup cartridge of a movable magnet type which can reduce the effective mass without decrease in sensitivity and is superior in characteristics, since a movable magnet which has a magnetic axis parallel to the modulation groove axis of the 45°–45° system stereo record through the combination of the movable magnets each having a magnetic axis in the direction of a horizontal axis and a vertical axis orthcgonal to the shaft of the cantilever.

Although the present invention has been described and illustrated in detail, it is to be clearly understood that the same is by way of illustration and example only and is not to be taken by way of limitation, the spirit and scope of the present invention being limited only by the terms of the appended claims.

What I claim is:

1. A pickup cartridge of a movable magnet type comprising a shaft of cantilever provided with a needle point at its tip end and with a magnet holder at its rear end, a movable magnet provided on said magnet holder comprising a movable magnet having a magnetic axis parallel to a vertical axis orthogonal to the shaft of cantilever, and two movable magnets provided on said magnet holder and each having a magnetic axis parallel to a horizontal axis orthogonal to the shaft of cantilever, the movable magnet on said vertical axis side and the movable magnets on said horizontal axis side being magnetized in different magnetizing directions, a means for supporting said magnet holder to allow free angular motion thereof in a vibration system, and a pair of yokes each having generating coils wound therearound and pole pieces magnetically connected thereto, a pair of adjacent movable magnets among the said movable magnets provided on said magnet holder being arranged opposite the corresponding pole pieces of the yoke so as to form a generating portion.

2. A pickup cartridge of a movable magnet type in accordance with claim 1, wherein the group of movable magnets constructing the vibration system is composed of one movable magnet having a magnetic axis parallel to the vertical axis orthogonal to the shaft of the cantilever and located above the cantilever, and two movable magnets each having a magnetic axis parallel to a horizontal axis orthogonal to the shaft of the cantilever and located sideways of the cantilever.

3. A pickup cartridge of a movable magnet type in accordance with claim 1, wherein the movable magnet has a magnetic axis parallel to the modulation groove axis of a 45°–45° system stereo record through the combination of the movable magnets each having a magnetic axis in the direction of a horizontal axis and a vertical axis orthogonal to the shaft of the cantilever.

4. A pickup cartridge of a movable magnet type in accordance with claim 1, wherein the movable magnet is formed of an isosceles triangle or quadrangle in shape.

5. A pickup cartridge of a movable magnet type in accordance with claim 1, wherein the movable magnet is formed of a rod in shape.

6. A pickup cartridge of a movable magnet type in accordance with claim 1, wherein the adjacent movable magnets as a pair from among the group of movable magnets constructing the vibration portion is rendered to be inserted between the mutually opposing pole pieces of the yoke constructing a generating portion thereby to oppose said pole pieces.

7. A pickup cartridge of a movable magnet type in accordance with claim 1, wherein the adjacent movable magnets as a pair from among the group of movable magnets constructing the vibration portion is rendered to oppose said pole pieces without being engaged between the mutually opposing pole pieces of the yoke constructing a generating portion.

8. A pickup cartridge of a movable magnet type in accordance with claim 1, wherein said magnet holder of magnetic material has rod-shaped projections in the direction of a horizontal axis orthogonal to the shaft of the cantilever, at least one movable magnet having a magnetic axis parallel to the vertical axis orthogonal to the shaft of the cantilever is provided at the central portion of said magnet holder, the vibration system including said magnet holder and adapted to support said movable magnets for free angular motion at the rear end of said cantilever, and pole pieces of the yoke with generating coils around it are opposite the movable magnet.

* * * * *